US008235213B2

(12) United States Patent
Berry et al.

(10) Patent No.: US 8,235,213 B2
(45) Date of Patent: Aug. 7, 2012

(54) PACKAGE

(75) Inventors: Simon Berry, Loughborough (GB); Eric Connolly, London (GB); Dave Salmon, London (GB)

(73) Assignee: Astrazeneca AB, Södertälje (SE)

( * ) Notice: Subject to any disclaimer, the term of this patent is extended or adjusted under 35 U.S.C. 154(b) by 266 days.

(21) Appl. No.: 12/243,348

(22) Filed: Oct. 1, 2008

(65) Prior Publication Data

US 2009/0084699 A1 Apr. 2, 2009

Related U.S. Application Data

(60) Provisional application No. 60/976,809, filed on Oct. 2, 2007.

(51) Int. Cl.
*B65D 85/00* (2006.01)

(52) U.S. Cl. ..... 206/461; 206/583

(58) Field of Classification Search ..... 206/461, 206/466, 438, 806, 471, 521, 583, 463
See application file for complete search history.

(56) References Cited

U.S. PATENT DOCUMENTS

| | | | | |
|---|---|---|---|---|
| 2,389,291 | A | 11/1945 | Bergstein | |
| 3,111,220 | A | 11/1963 | Bostrom | |
| 3,116,825 | A | 1/1964 | Thomas | |
| 3,127,993 | A | 4/1964 | Phipps | |
| 3,407,928 | A * | 10/1968 | Watts, Jr. | 206/463 |
| 3,554,367 | A * | 1/1971 | Hoover | 206/463 |
| 3,645,384 | A | 2/1972 | Wind | |
| 3,752,301 | A * | 8/1973 | Bluemel | 206/583 |
| 3,776,375 | A | 12/1973 | Rohdin | |
| 4,169,531 | A | 10/1979 | Wood | |
| 4,216,860 | A | 8/1980 | Heimann | |
| 4,375,262 | A | 3/1983 | Hrenyo | |
| 4,512,474 | A | 4/1985 | Harding | |
| 4,619,364 | A | 10/1986 | Czopor, Jr. | |
| 4,669,610 | A | 6/1987 | Lindsey et al. | |
| 4,681,223 | A | 7/1987 | Roberts | |
| 4,958,731 | A | 9/1990 | Calcerano | |
| D320,934 | S | 10/1991 | Cross et al. | |
| 5,090,570 | A | 2/1992 | Todd | |
| 5,129,516 | A | 7/1992 | Theros | |
| 5,176,634 | A | 1/1993 | Smith et al. | |
| 5,322,161 | A | 6/1994 | Shichman et al. | |

(Continued)

FOREIGN PATENT DOCUMENTS

EP 0 383 208 A1 8/1990

(Continued)

OTHER PUBLICATIONS

International Search Report and Written Opinion issued in International Patent Application No. PCT/SE2008/051106; Date of Mailing: Mar. 23, 2009.

(Continued)

*Primary Examiner* — J. Gregory Pickett
*Assistant Examiner* — King M Chu
(74) *Attorney, Agent, or Firm* — Finnegan, Henderson, Farabow, Garrett & Dunner, LLP

(57) ABSTRACT

A package for a dispensing device, comprising a protection pouch arranged to enclose the dispensing device. The protection pouch comprises a base section that is arranged to support the dispensing device in the general vertical direction, and the package comprises a support member arranged to essentially elevate the base section of the pouch from a support surface.

20 Claims, 9 Drawing Sheets

U.S. PATENT DOCUMENTS

| | | | | |
|---|---|---|---|---|
| 5,358,113 | A | 10/1994 | Hellenbrand | |
| 5,485,919 | A | 1/1996 | Samberg et al. | |
| 5,560,490 | A | 10/1996 | Chawla | |
| 5,642,810 | A | 7/1997 | Warner et al. | |
| 5,871,097 | A | 2/1999 | Shida et al. | |
| 6,080,456 | A | 6/2000 | Fonteyne | |
| 6,119,853 | A | 9/2000 | Garrill et al. | |
| 7,021,458 | B2 * | 4/2006 | Cummings | 206/77.1 |
| 7,398,879 | B2 | 7/2008 | Nottingham et al. | |
| 2004/0089561 | A1 * | 5/2004 | Herman | 206/204 |
| 2006/0091037 | A1 * | 5/2006 | Grote et al. | 206/471 |
| 2006/0144735 | A1 | 7/2006 | Baker | |
| 2006/0215978 | A1 | 9/2006 | Choy et al. | |
| 2007/0051652 | A1 * | 3/2007 | Tilton | 206/462 |
| 2007/0102317 | A1 | 5/2007 | Crawford et al. | |
| 2007/0261980 | A1 * | 11/2007 | Cox et al. | 206/438 |
| 2009/0139888 | A1 | 6/2009 | Berry et al. | |
| 2011/0017626 | A1 | 1/2011 | Berry et al. | |

FOREIGN PATENT DOCUMENTS

| | | | |
|---|---|---|---|
| GB | 1 481 378 | A | 7/1977 |
| WO | WO 99/27813 | | 6/1999 |
| WO | WO 01/87392 | A2 | 11/2001 |
| WO | WO 01/98175 | A1 | 12/2001 |
| WO | WO 2006/003386 | A1 | 1/2006 |
| WO | WO 2006/106932 | A1 | 10/2006 |

OTHER PUBLICATIONS

International Search Report and Written Opinion issued in International Patent Application No. PCT/SE2008/051270; Date of Mailing: Mar. 19, 2009.

* cited by examiner

PACKAGE

This application claims the benefit of the filing date of U.S. Provisional Application No. 60/976,809, which was filed on Oct. 2, 2007. The contents of U.S. Application No. 60/976,809 are incorporated by reference in their entirety as part of this application.

TECHNICAL FIELD

The invention relates to medicinal dispensing device packaging, such as a package for containing, for example, a pressurized metered dose inhaler (hereinafter referred to as a "pMDI") or a dry powder inhaler (DPI).

BACKGROUND pMDIs are well known in the art of inhalation devices. It is therefore not necessary to describe the construction and operation of a pMDI other than in bare essentials.

A pMDI comprises a canister unit and a housing. The housing is generally tubular and formed of a plastic material, for instance by molding. The canister unit comprises a canister having one open end, typically made from a metal such as aluminum. The open end of the canister is sealingly capped by a metering valve assembly. The valve assembly includes a hollow dispensing member, usually in the form of a valve stem, which projects from the open end of the canister. Actuation of the metering valve assembly results in a metered dose of the aerosol formulation being dispensed from the canister through the valve stem.

In use, the sealed canister contains a pressurized medicinal aerosol formulation. The formulation comprises the medicament and a fluid propellant, and optionally one or more excipients and/or adjuvants. The medicament is typically in solution or suspension in the formulation.

The housing comprises an internal passageway having an open end. A nozzle block is arranged to receive the valve stem from the canister unit, and to direct the dispensed metered dose to a mouth piece (or nasal piece). In use, a patient in need of a metered dose of the medicinal aerosol formulation concurrently inhales on the mouthpiece and actuates the canister unit. The inspiratory airflow produced by the patient entrains the metered dose of the medicinal aerosol formulation into the patient's respiratory tract.

Dispensing devices are commonly stored in a sealed protection pouch inside a cardboard box or the like. Depending on the type of dispensing device and requirements related thereto, the protection pouch may be arranged to keep the dispensing device, and/or protected from moisture, contamination, and/or dust. The protection pouch is commonly made from a thin flexible material such as plastic film, coated paper, metal foil, laminates thereof or the like, hereafter referred to as pouch material.

WO-A-2001/87392 A1 describes a sealed pouch that allegedly prevents moisture ingress but is said to be permeable to the propellant gas of the pMDI contained therein. This is said to prevent the protective pouch from bursting if its interior pressure increases due to leakage of the propellant from the container. To further enhance moisture protection, a desiccant may be provided inside the pouch.

It has been concluded that current protection pouch designs may be susceptible to punctures due to fatigue failure in the materials and due to impacts from sharp edges on the inhaler. Fatigue failure frequently occurs at crease points in the pouch, where the material is worn and work hardened during vibration. The foil material punctures in the lower portion of the pouch, generally close to the sides and at evident fold points in the foil. This failure is caused by the vertical movement of the pouch and contents within the product carton during handling, transport, etc, whereby the foil pouch e.g. flexes at natural folds.

WO 2006/003386 discloses a package for a dispenser in the form of an inhaler, comprising a support arranged to suspend the dispenser in order to avoid unintentional actuation. Several types of suspension arrangements are proposed, all arranged to allow a controlled suspended movement of the inhaler inside the package. However, there are no specific provisions for avoiding punctures of the sealed pouch.

SUMMARY

In one implementation, a dispensing device package includes a protection pouch for enclosing a dispensing device, e.g., a pMDI or a DPI. The protection pouch has a base section for supporting the dispensing device in a substantially vertical direction. The dispensing device package also includes a support member, e.g. one or more rigid boards attached to the protection pouch, for elevating the base section of the pouch from a support surface. The support member(s) may also include patient information in the form of a leaflet.

In some implementations, the protection pouch and the support member(s) are arranged in a box. In some implementations, the support member is formed by a wall of the box in which the protection pouch is arranged. The protection pouch is attached to the wall of the box such that the base section of the pouch is elevated from the bottom of the box.

Some implementations include a protection pouch having two vertical seals and a first and second support member, e.g. two rigid boards. Each support member is attached to a corresponding one of the two vertical seals. In some implementations, the one or more support members are integrally formed with the protection pouch, e.g. by one or more supporting seals. In some implementations, the one or more supporting seals include a stiffening texture. The one or more supporting seals may include vertical sealing edges. In some implementations, the protection pouch has a substantially flat base wall which is surrounded and elevated by the one or more supporting sealing edges adjacent the base section of the protection pouch.

Some implementations may include one or more stiffening support rims attached to at least a section of the one or more supporting seals, e.g., the sealing edges surrounding the base section of the protection pouch. In some implementations, the dispensing device is a medicinal device, e.g., an inhaler, and is contained within the protection pouch.

In another implementation, a dispensing device protection pouch is configured to enclose an associated dispensing device. The protection pouch includes one or more movement restricting sections arranged to reduce relative movement of the dispensing device inside the protection pouch. The movement restricting sections are formed by interconnected facing non-edge sections of the protection pouch. In some implementations the dispensing device, e.g., an inhaler, is enclosed within the protection pouch.

In yet another implementation, a dispensing device box is configured to enclose an associated dispensing device. The box includes one or more "push in" type retaining members formed to reduce relative movement of the dispensing device inside the box. In some implementations, the associated dispensing device, e.g., an inhaler, is enclosed within the box.

The package described herein may be able to vastly lower the risk for punctures of the protection pouch containing the dispensing device.

The details of one or more embodiments of the invention are set forth in the accompanying drawings and the description below. Other features, objects, and advantages of the invention will be apparent from the description and drawings, and from the claims.

DESCRIPTION OF DRAWINGS

Similar reference numbers in different figures indicate similar elements.

DETAILED DESCRIPTION

Figure 1A:
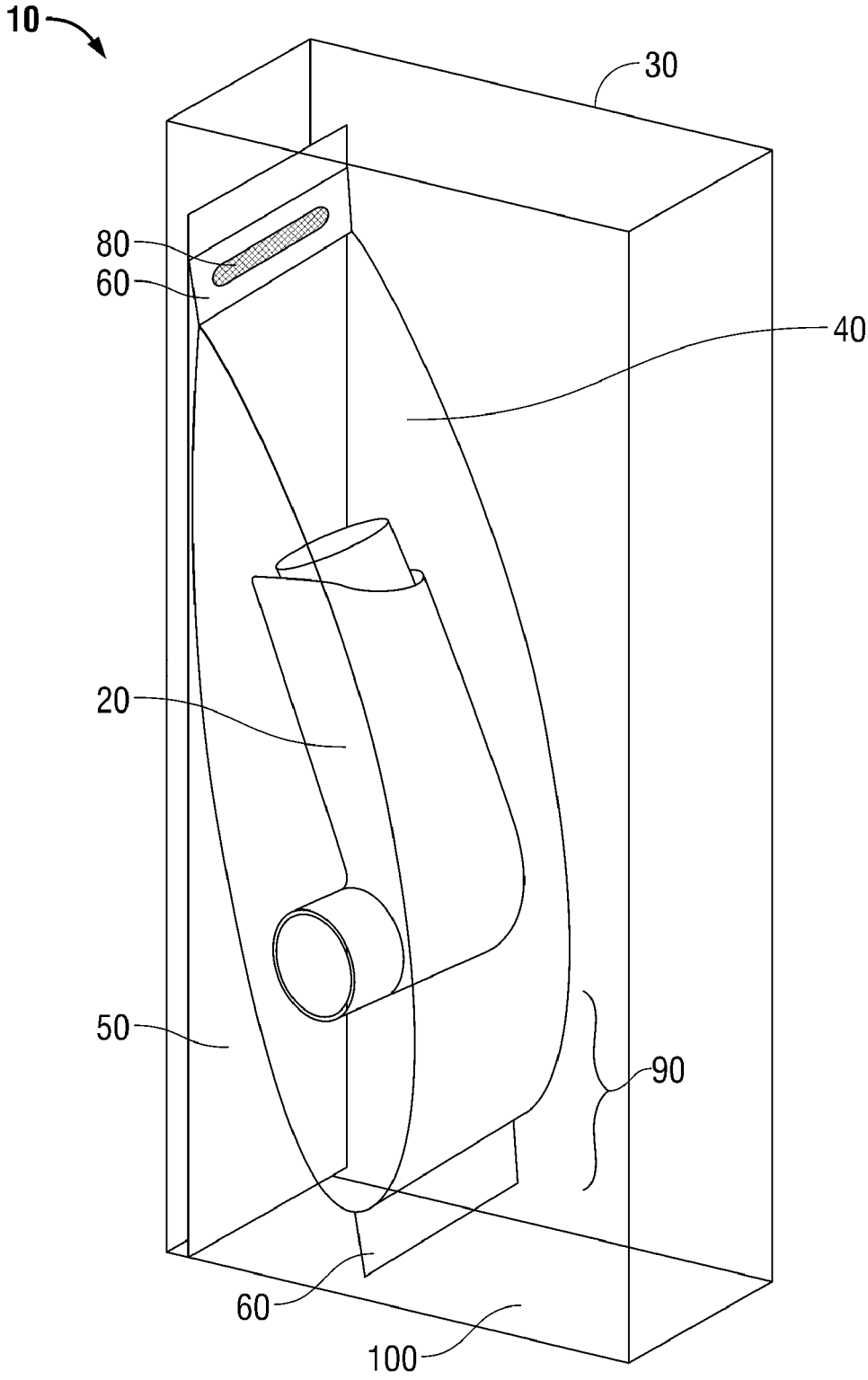
FIGS. 1*a* and 1*b* are schematic perspective views of two embodiments of a package according to the present invention.

FIG. 1*a* is a schematic perspective view of an embodiment of a package 10 for a dispensing device 20, in the form of a pMDI. The package 10 is comprised of a box 30, a protection pouch 40 and a pouch support member 50. The box 30 may be of many different shapes and of different size depending on the dispensing device 20 to be contained therein. Examples of shapes include classic brick type, tetrahedron type and tube like, as well as any other suitable shape. The box 30 may be comprised of a large selection of materials that provide sufficient rigidity, such as cardboard, plastic, metal etc. The Box 30 mainly serves to facilitate handling of the package 10 at the same time as it provides display surfaces whereupon informative and display information can be printed.

As is discussed above, the protection pouch 40 may be comprised of any suitable barrier material herein referred to as pouch material. There are numerous ways of forming pouches 40 and possible forming processes will not be discussed in full detail herein. In the disclosed embodiment, the pouch 40 is provided with two sealing edges 60, at the top and at the bottom thereof, respectively, defining a sealed pouch there between. The sealing edges 60 are sealed in an appropriate way depending on the pouch material, such as by heat or friction welding, by use of a suitable adhesive or the like. Other embodiments may comprise one or more longitudinal seals depending on the type of pouch.

As mentioned above, most puncture failures of the pouch 40 occur at the base section 90 thereof, and are due to fatigue failure in the pouch material and due to impacts from sharp edges on the dispensing device 20. In order to avoid this, the pouch 40 is attached to a support member 50, that is arranged to support the pouch inside the box 30 by essentially elevating the base section 90 of the pouch 40 and thus the dispensing device 20 from the bottom of the box 30. According to one embodiment, the support member 50 is comprised of a rigid board, attached to one face of the pouch 40. The support board 50 may be attached to the pouch 40 by an adhesive material, such as hot melt glue indicated by 80 in FIG. 1*a*, by a fastening member such as a staple or the like, or mechanically by, e.g., forming a hook on the support board and a mating hole in the upper seal of the pouch 40. The support board 50 may be attached to the pouch 30 at more than one point giving a close attachment that may reduce the risk for punctures even further. The support board 50 is attached to the pouch 40 so that the base section 90 of the pouch 40, and thus the dispensing device 20, is essentially elevated from the base surface 100 of the box 30 when in position therein. Some contact can be accepted depending on the nature of the support board 50, however, pouch material flexing and creasing at the base section 90 of the pouch 40 is kept to a minimum.

Throughout this description, the term base section 90 refers to the lower section of the pouch 40 cavity wherein the dispensing device 20 is contained. The base section 90 is arranged to essentially support the dispensing device 20 in the general vertical direction. Therefore, by essentially elevating the base section 90 from the base surface 100 involves elevating the dispensing device 20 from the same, whereby a more static load situation is achieved between the dispensing device 20 and the base section 90. As is shown by some embodiments, the pouch 40 may comprise one or more parts that extend below the base section 90, e.g., a lower seal 60, or a support member or the like, and which, in some cases, are in direct contact with the base surface 100. According to some embodiments, the elevation of the base section 90 is provided for by such portions of the pouch 40 that extend below the base section 90 and thus support the base section 90 and the dispensing device at an elevated position, i.e. the support member is integrally formed with the pouch 40 itself. The base surface 100 may be a bottom surface of a box 30 as in the above embodiments, but it may also be a general support surface such as a shelf top as would be the case when the pouch 40 itself forms a stand alone package.

Figure 1B:
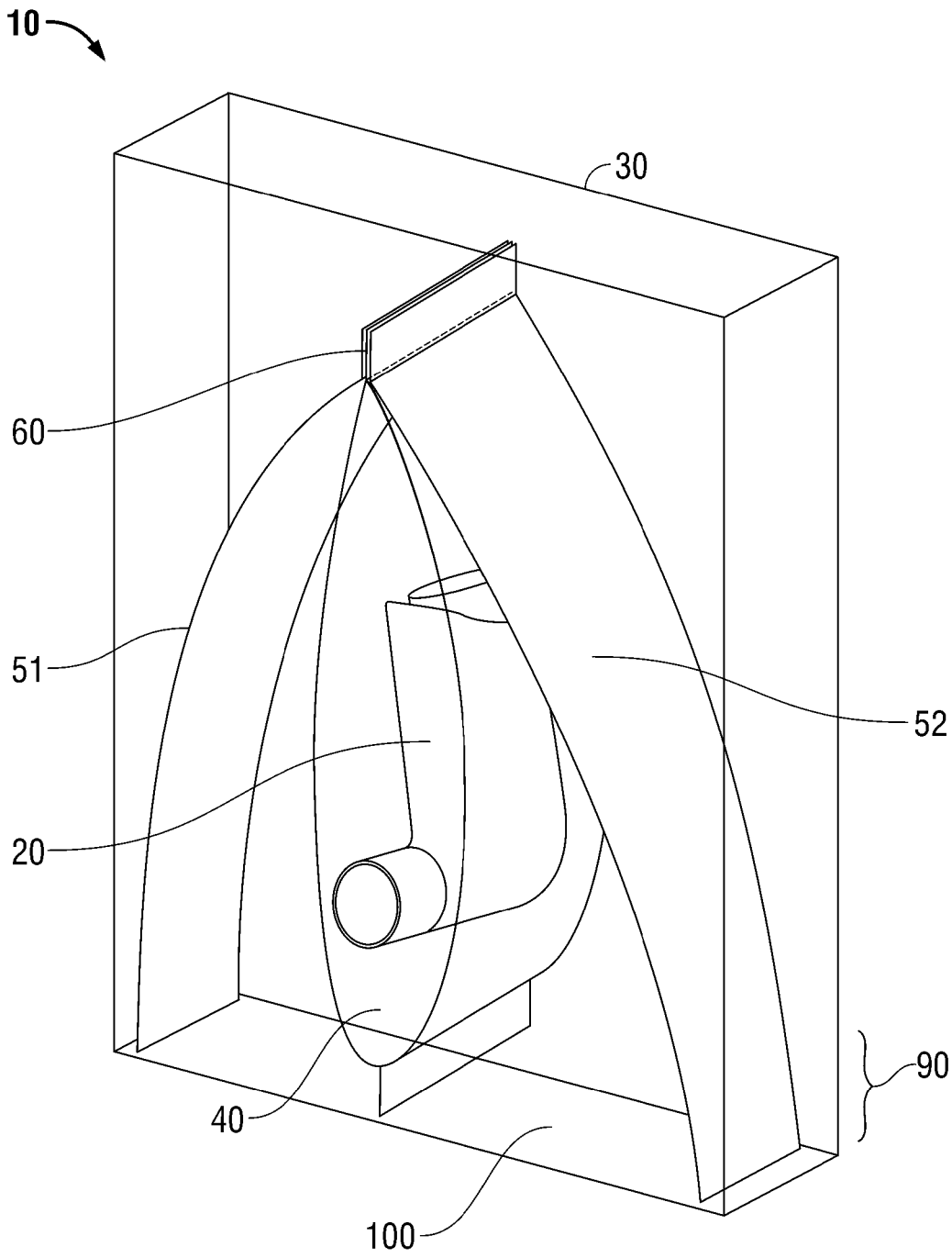

According to another embodiment, shown in FIG. 1*b*, the support member 50 is comprised of two support boards 51 and 52, both attached to the upper sealing edge 60 and arranged to elevate the pouch 40, and thus the dispensing device 20, there between. The support boards 51 and 52 may be integrally formed as one folded board. Depending on the dimensions of the box 30 and the support boards 51 and 52, this embodiment may further allow controlled support in the sideways directions since the support boards 51 and 52 may limit movement of the pouch 40 in the horizontal direction. In the disclosed embodiments, some dimensions are exaggerated for illustrative purposes.

According to one embodiment, the support member(s) 50, 51, and /or 52 are comprised of a patient information leaflet. By being attached to the top of the pouch 40, a patient is required to remove the leaflet before opening the pouch 40. This is a positive interaction as the patient is forced to interact with the leaflet.

In the embodiments disclosed in FIGS. 1*a* and 1*b*, the support member(s) 50, 51, and/or 52 are preferably attached to the pouch 40 before being inserted into the box 30.

Figure 2:
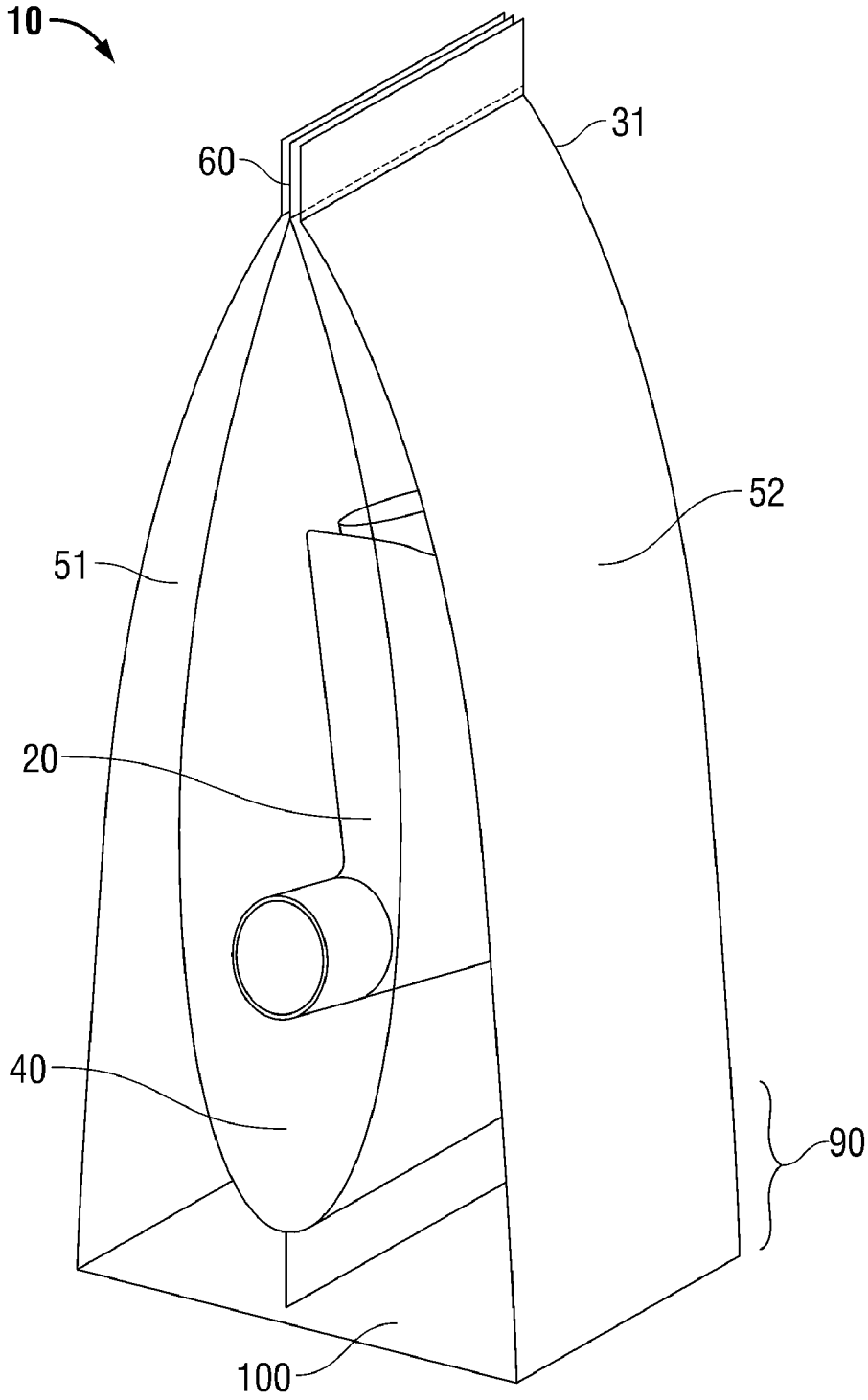
FIG. 2 is a schematic perspective view of another embodiment of a package according to the present invention.

FIG. 2 shows an embodiment similar to that of FIG. 1*b*, but wherein the box 30 has been omitted and the support boards 51 and 52 have been converted into a self supporting support arrangement 31 to constitute the main structural member of the package 10. In this embodiment, the support arrangement 31 has been provided with a base 100 that interconnects the two support members which are in turn interconnected at the upper end where the pouch 40 is attached so that its base section 90 is essentially elevated from the base 100. According to other embodiments, the support arrangement 31 may be provided with side walls interconnecting the support boards 51 and 52 (not shown). The support arrangement may further be arranged in a box 30 like in FIGS. 1*a* and 1*b*.

Figure 3:
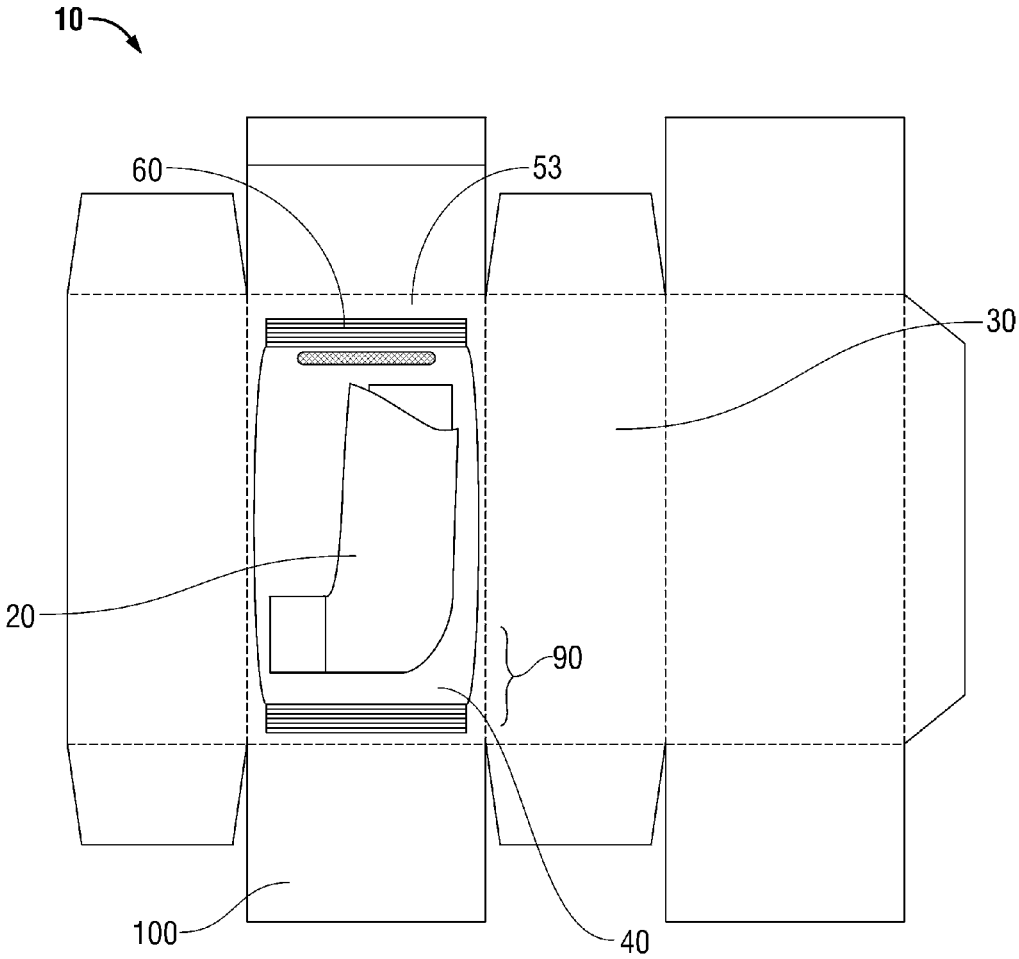
FIG. 3 is a schematic view of still another embodiment of a package according to the present invention, in an unfolded state.

In the embodiment disclosed in FIG. 3, the support member is integrated as one side wall of the box 30. FIG. 3 shows the package 10 in an unfolded state, wherein the pouch 40 containing the pMDI 20 is attached to a portion of the unfolded box 30, representing a side wall 53 of the finished box 30. Like in the above embodiments, the support member/ side wall 53 is made longer than the pouch, and the pouch 40 is attached to the side wall so that the base section 90 thereof is essentially elevated from the bottom 100 of the finished box. In FIG. 3, the bottom 100 is represented by the lower tabs. Like in the above embodiments, the pouch can be attached to the support member/ side wall 53 by any suitable means for fastening, such as glue, etc.

In the embodiment of FIG. 3, the pouch 40 is arranged on and attached to the box 30 in the unfolded state, where after the box 30 is folded to its finished state in a following folding step. Alternatively, the pouch may be attached to a side wall 53 of a box 30 in a semi folded state, wherein previously folded walls may function as guides for the pouch 40 during the attachment step (not shown). Because, the step of folding is performed, at least partially, after the pouch 40 with the pMDI 20 is arranged in position and the step of inserting the pouch into the folded box is omitted, the box 30 may be smaller thereby requiring less volume during transport and storage. By wrapping the box about the pouch 40 the likelihood of creasing is decreased and the pouch will be subjected to less stress.

Figure 4A:
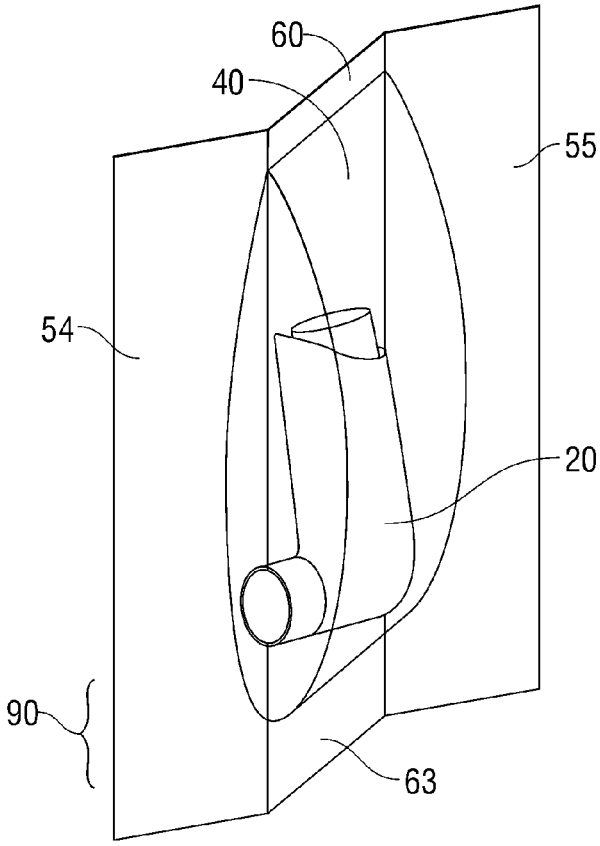
FIGS. 4*a* to 4*d* show embodiments of a protection pouch and a package according to the present invention.
Figure 4B:
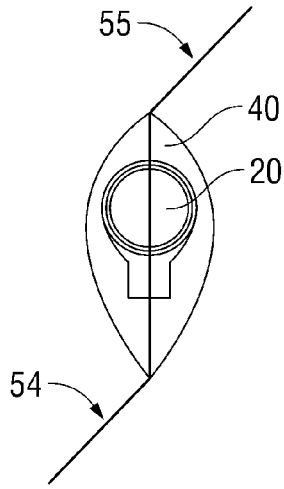
Figure 4C:
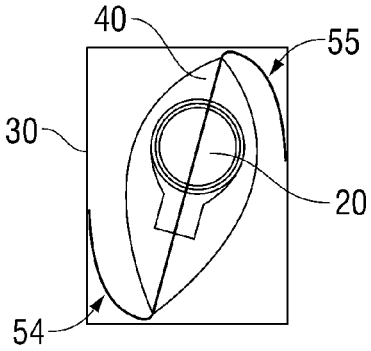
Figure 4D:
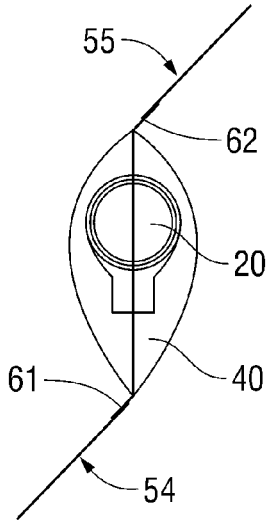

In the embodiment disclosed in FIGS. 4*a* to 4*c*, two support members 54 and 55 are formed as integrated parts of the pouch 40 in that rigid side sealing edges of the pouch 40 are extended sideways. The support members 54 and 55 are thus formed of a double laminate of the pouch material. By selecting a suitable pouch material, and/or by giving the side sealing edges 54 and 55 a stiffening texture, e.g., in a heat welding process, the side sealing edges 54 and 55 can be made more rigid, yet flexible enough to act as support members and retain the pouch 40 in a more or less fixed position inside the box 30. FIG. 4*c* shows a pouch 40 with a dispensing device 20 arranged in a box 30, wherein the support members 54 and 55 have been curved in an "S" configuration, whereby their vertical rigidity is enhanced by their curvature, and their elasticity effectively fixes the pouch 40 in the horizontal plane. In an alternative embodiment, disclosed in FIG. 4*d*, the support members 54 and 55 are formed by boards separate from the pouch 40, such as card board, rigid plastic or the like, that are attached to normal sized side sealing edges 61 and 62. In one embodiment (not shown), the boards forming the support members 54 and 55 are integrally formed in that they are interconnected at least at the lower section corresponding to the seal 63, leading to enhanced rigidity of the lower seal.

Due to the firm support of the dispensing device 20 in the package 10 according to the embodiment of FIGS. 4*a* to 4*d* the risk for punctures is reduced, and the section 90 of the pouch 40 is essentially elevated from the base 100. Moreover, the curved support members 54 and 55 effectively prevent foil flexing and creasing at the base 90 of the pouch 40.

Figure 5A:
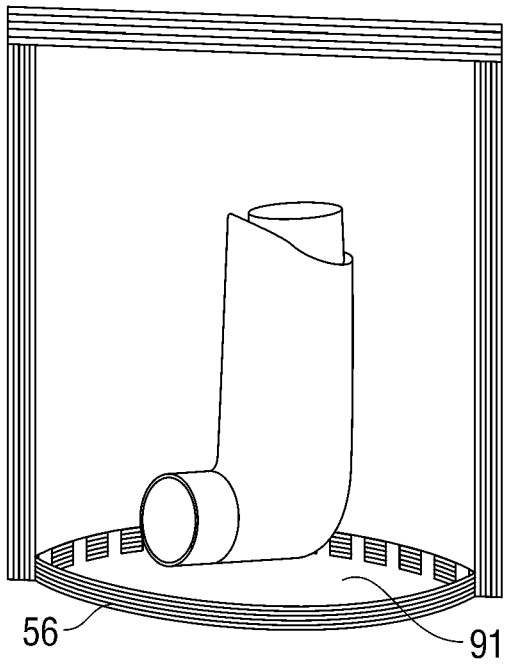
FIGS. 5*a* to 5*f* show embodiments of another protection pouch and a package according to the present invention.
Figure 5B:
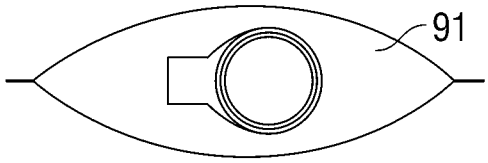
Figure 5C:
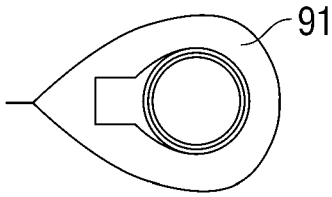
Figure 5D:
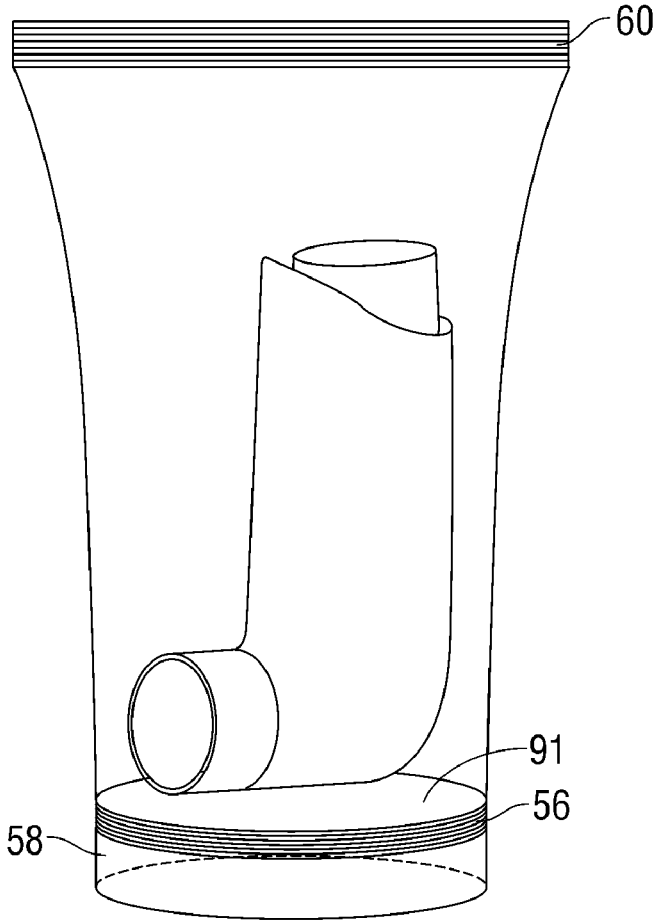
Figure 5E:
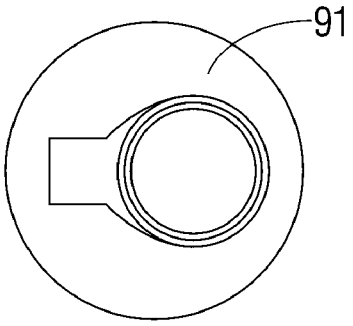
Figure 5F:
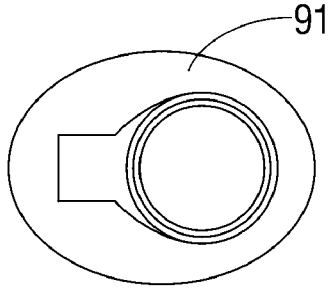

In the embodiment of FIGS. 5*a* to 5*f*, the pouch 40 is provided with a support member 56 that surrounds, embraces and elevates an essentially flat base wall 91 thereof. The base wall 91 is formed by attaching a separate piece of foil material at the base section 90 of a pouch 40, with the sealing edge 56 directed in the downward direction. Like in the embodiment of FIGS. 4*a* to 4*d*, the curved double layer pouch material provides a rigid support structure capable of elevating the so created base wall 91. In the embodiment disclosed in FIG. 5*a*, the pouch 40 is comprised of two sheets of pouch material that are sealed along their edges and to the base wall 91 to achieve a sealed pouch 40. FIG. 5*b* is a top view of the base wall 91 of the pouch 40 according to FIG. 5*a*. FIG. 5*c* shows a corresponding view of an embodiment of a pouch 40 comprised of one sheet of foil material that is sealed along its edges and to the base wall 91. FIGS. 5*d* to 5*f* shows two embodiments of a pouch 40 comprised of a base wall 91 and a tubular sheet of pouch material that is sealed along a bottom edge. As can be understood from the figures, the shape of base wall 91 is adapted to the specific design of the pouch 40.

The elevated base wall 91, according to these embodiments, provides an excellent support for the dispensing device 20, elevating and suspending it from direct contact with a surface supporting the pouch 40. In accordance with the above embodiments, the pouch 40 according to the FIGS. 5*a* to 5*f* may be inserted into a box 30. Alternatively, the pouch 40 according to the FIGS. 5*a* to 5*f* may be used as a stand alone package 10 for dispensing device 20, much like similar packages that are used for packaging of liquids, powders, and granulated foodstuff or the like. If the pouch 40 is used as a stand alone package 10, a patient leaflet (not shown) may be arranged inside the pouch together with the dispensing device, or alternatively attached to the outside of the pouch 40. According to one embodiment, one or more stiffening support rims or members 58 are attached to at least a section of the sealing edge 56 of the protective pouch 40 in order to further enhance the stiffness of the so formed support member 56 defining the base wall 91.

Figure 6B:
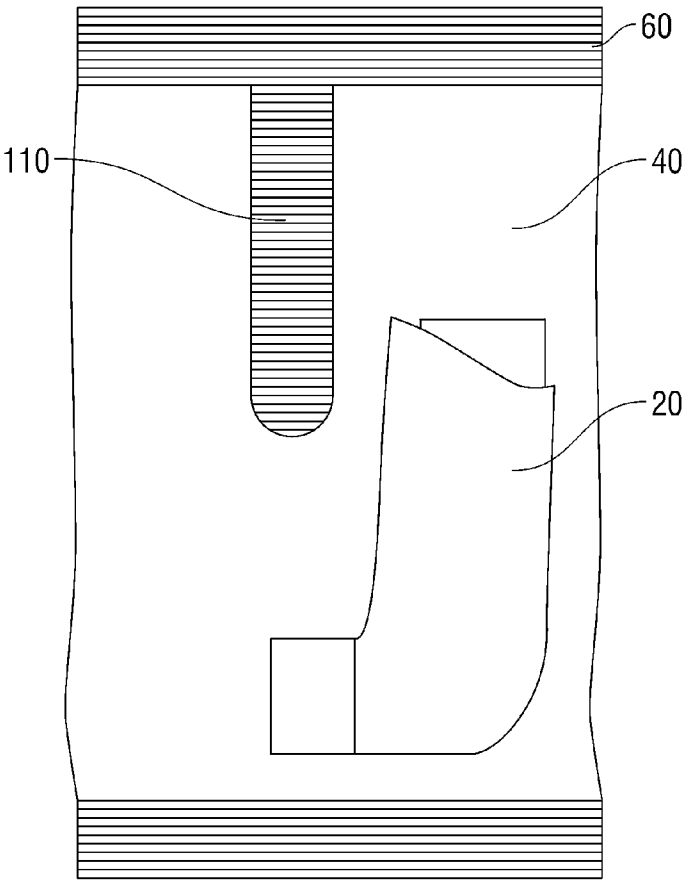
FIGS. 6*a* and 6*b* shows two embodiments of a protection pouch according to the present invention.
Figure 6A:
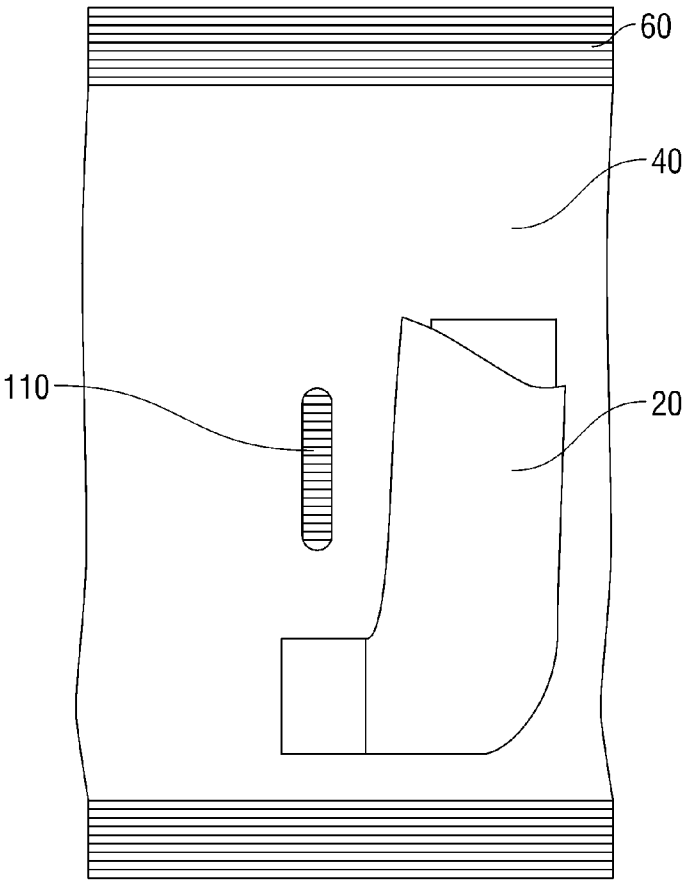

In order to further reduce the relative movement of the dispensing device 20 inside the pouch 40, one or more movement restricting sections may be formed wherein facing non-edge sections of the pouch 40 are interconnected. The facing non-edge sections of the pouch 40 can be interconnected in any suitable way such as by welding, adhesive or the like. FIGS. 6*a* and 6*b* discloses two embodiments of such movement restricting sections. In FIG. 6*a* a separate restricting section 110 is formed to restrict vertical and horizontal movement of the dispensing device 20 within the pouch 40. Such a separate section may be formed in a separate step preceding, during, or following the step of sealing the pouch 40 by a sealing edge 60. In FIG. 6*b*, the retaining weld 110 is combined with the sealing edge 60, and is thus performed in one single sealing step. By restricting pMDI movement within the pouch 40, punctures due to impact from sharp edges of the dispensing device 20 are effectively reduced. In FIGS. 6*a* and 6*b*, the pouch 40 is of a conventional type, with a top and bottom sealing edge 60, as is disclosed in the embodiments of FIGS. 1 and 2. However, all embodiments of pouches 40 disclosed herein, as well as other types, may be provided with retaining welds 110 of this type.

Figure 7:
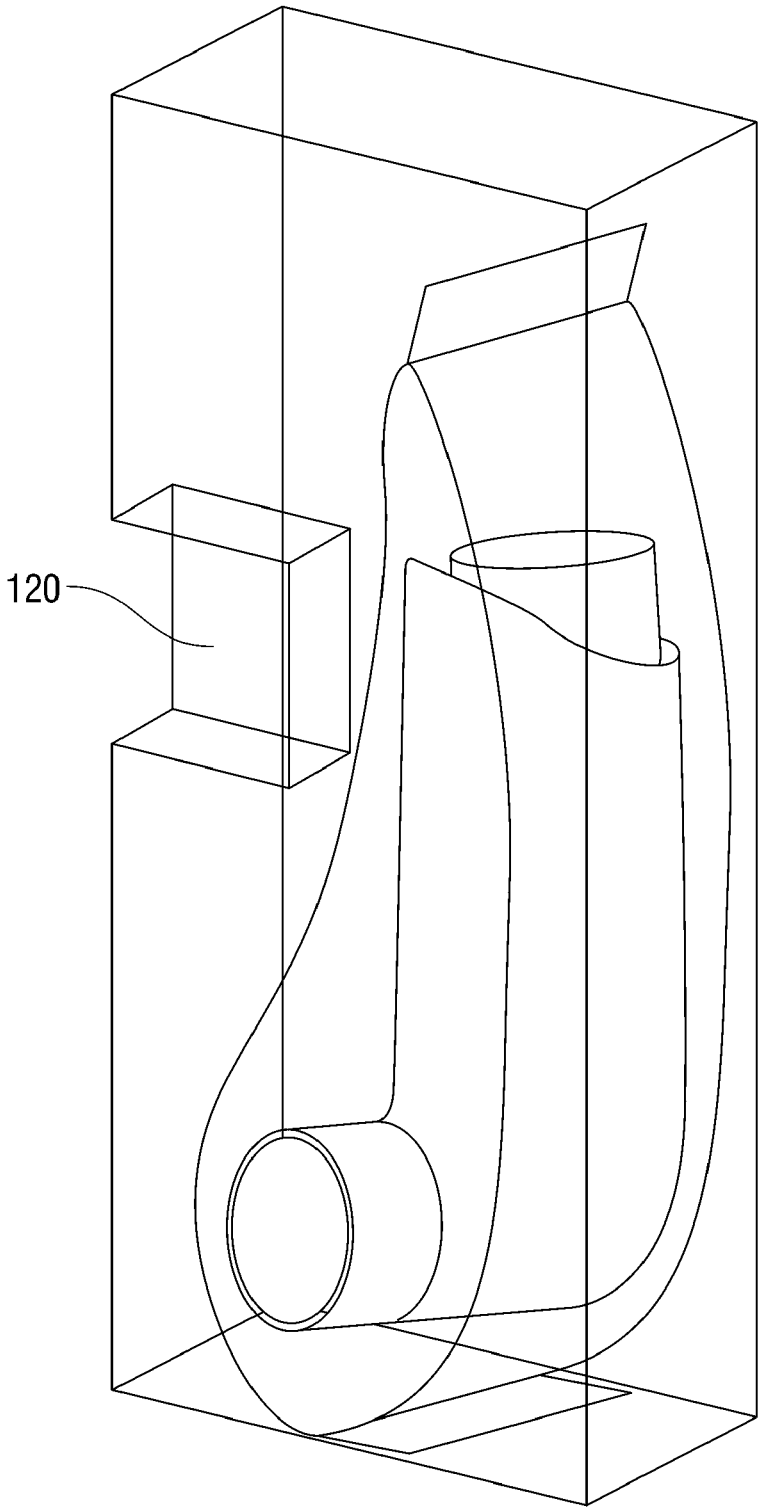
FIG. 7 shows an embodiment of a protection package according to the present invention.

FIG. 7 shows an alternative way of restricting the movement of a dispensing device 20 inside a package 10, wherein the box 30 is provided with one or more retaining members 120 of a "push in" type. Such push in retaining members 120 may be used in lieu of or in combination with the above embodiments comprising support members arranged to elevate the base section 90 of the pouch 40.

What is claimed is:

1. A drug-dispensing device package, comprising:

a protection pouch arranged to enclose a drug-dispensing device, the protection pouch including a pouch material having an upper sealing edge and a lower sealing edge, the upper sealing edge and the lower sealing edge defining a pouch therebetween, the pouch arranged to support the drug-dispensing device in a substantially vertical direction;

a first side sealing edge attached to a first support member; and a second side sealing edge attached to a second support member, wherein the first side sealing edge includes a first fold positioned along the first side sealing edge, and the second side sealing edge includes a second fold positioned along the second side sealing edge opposite the first side sealing edge, wherein the pouch is bounded by the upper sealing edge, the lower sealing edge, the first fold, and the second fold, wherein the the first support member and the second support member are attached to the pouch along an entirety of the length of the pouch and configured to elevate the lower sealing edge from a base surface located generally underneath the lower sealing edge.

2. The package of claim 1, wherein the protection pouch and the first and second support members are arranged in a box.

3. The package of claim 2, wherein each of the first and second support members includes a rigid support board.

4. The package of claim 1, wherein the drug-dispensing device includes an inhaler.

5. The package of claim 1, further including the drug-dispensing device.

6. A drug-dispensing device package, comprising:

a pouch configured to orient a dispensing device, the pouch including a base section configured to support the dispensing device in a substantially vertical direction;

a base surface located generally underneath the pouch;

a first side sealing edge attached to a first support member; and a second side sealing edge attached to a second support member, wherein the first side sealing edge includes a first fold positioned along the first side sealing edge, and the second side sealing edge includes a second fold positioned along the second sealing edge opposite the first side sealing edge, wherein the pouch is bounded by an upper sealing edge, a lower sealing edge, the first fold, and the second fold, wherein the first support member and the second support member are attached to the pouch along an entirety of the length of the pouch, wherein the pouch is suspended above the base surface.

7. The package of claim 6, wherein each of the first and second support members is rigid and extends from the pouch to the base surface.

8. The package of claim 7, wherein each of the first and second support members is generally curved when in a packaged condition.

9. The package of claim 6, wherein the upper sealing edge is attached to the first and second support members.

10. The package of claim 6, wherein the pouch includes a first opening configured to receive the dispensing device.

11. The package of claim 10, wherein the pouch further includes a second opening different to the first opening and configured to receive the dispensing device.

12. The package of claim 1, wherein the first support member includes a first rigid support board and the second support member includes a second rigid support board.

13. The package of claim 12, wherein the first rigid support board is attached to the upper sealing edge at an upper end of the first rigid support board and is attached to the lower sealing edge at a lower end of the first rigid support board, and the second rigid support board is attached to the upper sealing edge at an upper end of the second rigid support board and is attached to the lower sealing edge at a lower end of the second rigid support board.

14. A drug-dispensing device package, comprising:

a protection pouch enclosing a drug-dispensing device, the protection pouch including a pouch material with at least an upper sealing edge, the pouch arranged to support the drug-dispensing device in a substantially vertical direction beneath the upper sealing edge;

a first support member and a second support member attached to the pouch along an entirety of the length of the pouch and configured to elevate a bottom portion of the pouch above a base surface; and a box receiving and enclosing the protection pouch, wherein a base of the box at least partially defines the base surface, wherein the first and second support members form an S-shaped configuration, whereby a vertical rigidity of the first and second support members is enhanced by a curvature of the first and second support members, and elasticity of the first and second support members fixes the pouch in a horizontal plane.

15. The package of claim 14, further including the drug-dispensing device, wherein the drug-dispensing device includes an inhaler.

16. The package of claim 6, wherein the base section includes the lower sealing edge positioned proximate the base surface and configured to at least partially support the dispensing device.

17. The package of claim 1, wherein the first fold is located between the first support member and the lower sealing edge, and the second fold is located between the second support member and the lower sealing edge.

18. The package of claim 1, wherein the first fold is located between the first support member and the upper sealing edge, and the second fold is located between the second support member and the upper sealing edge.

19. The package of claim 1, wherein the first and second side sealing edges extend between the upper sealing edge and the lower sealing edge, the first side sealing edge being fixedly attached to the first support member, and the second side sealing edge being fixedly attached to the second support member.

20. The package of claim 19, wherein the first fold extends continuously from an uppermost end of the first side sealing edge to a bottommost end of the first side sealing edge, and the second fold extends continuously from an uppermost end of the second side sealing edge to a bottommost end of the second side sealing edge.

* * * * *